US008677560B2

(12) United States Patent
Bacchetti

(10) Patent No.: US 8,677,560 B2
(45) **Date of Patent: *Mar. 25, 2014**

(54) DOOR CLOSER, PARTICULARLY FOR GLASS DOORS

(71) Applicant: IN&TEC S.r.l, Brescia (IT)

(72) Inventor: Luciano Bacchetti, Nave (IT)

(73) Assignee: IN&TEC S.r.l., Brescia (IT)

( * ) Notice: Subject to any disclaimer, the term of this patent is extended or adjusted under 35 U.S.C. 154(b) by 0 days.

This patent is subject to a terminal disclaimer.

(21) Appl. No.: 13/865,397

(22) Filed: Apr. 18, 2013

(65) Prior Publication Data

US 2013/0227814 A1 Sep. 5, 2013

Related U.S. Application Data

(63) Continuation of application No. 13/578,962, filed as application No. PCT/EP2011/065380 on Sep. 6, 2011, now Pat. No. 8,443,487.

(30) Foreign Application Priority Data

Sep. 6, 2010 (EP) ..... 10175479
Oct. 13, 2010 (EP) ..... 10187458

(51) Int. Cl.
*E05D 7/08* (2006.01)
*E05F 1/00* (2006.01)

(52) U.S. Cl.
USPC ..... 16/51; 16/54; 16/71; 16/72; 16/378; 16/252

(58) Field of Classification Search
USPC ..... 16/50, 54, 68, 58, 71, 78, 80, 49, 51, 16/318, 319, 280, 281, 310, 316, 317, 378, 16/252; 49/339, 334, 340, 323, 324, 344, 49/137, 138
See application file for complete search history.

(56) References Cited

U.S. PATENT DOCUMENTS

| | | | | |
|---|---|---|---|---|
| 4,378,612 | A * | 4/1983 | Beers | 16/62 |
| 4,394,787 | A * | 7/1983 | Lieberman | 16/58 |
| 5,913,763 | A * | 6/1999 | Beran et al. | 49/506 |
| 7,007,341 | B2 * | 3/2006 | Wang | 16/60 |
| 2004/0206007 | A1 * | 10/2004 | Chiang | 49/388 |
| 2007/0228742 | A1 * | 10/2007 | Chiang | 292/163 |
| 2008/0022490 | A1 * | 1/2008 | Ginzel et al. | 16/51 |
| 2010/0024159 | A1 * | 2/2010 | Oh et al. | 16/54 |
| 2010/0199459 | A1 | 8/2010 | Bacchetti | |
| 2012/0117755 | A1 * | 5/2012 | Walhorn | 16/66 |

FOREIGN PATENT DOCUMENTS

| | | | |
|---|---|---|---|
| BE | 503424 | | 6/1951 |
| EP | 1205669 | A1 * | 5/2002 |
| EP | 2138662 | | 12/2009 |
| GB | 1168983 | | 10/1969 |
| GB | 2008184 | | 5/1979 |
| KR | 2007000806 | A * | 1/2007 |
| KR | 718239 | B1 * | 5/2007 |

* cited by examiner

*Primary Examiner* — Chuck Mah
(74) *Attorney, Agent, or Firm* — Themis Law

(57) ABSTRACT

A door closer for doors, particularly glass doors, which are supported by a stationary support structure and are movable between an open door position and a closed door position. The door closer comprises a box-shaped body and a pin reciprocally coupled to rotate around a first axis between the open door position and the closed door position. A closing mechanism causes the door to return automatically and a braking mechanism counteracts the action of the closing mechanism. First and second cam elements are unitary with the pin and interposed between a first and second plunger elements acting thereon.

19 Claims, 7 Drawing Sheets

DOOR CLOSER, PARTICULARLY FOR GLASS DOORS

FIELD OF THE INVENTION

The present invention is generally applicable in the technical field of the closing hinges, and particularly relates to a door closer, in particular for glass doors.

BACKGROUND OF THE INVENTION

As known, door closers are generally used to close a door which is supported by a stationary structure, e.g. a door frame.

Door closer usually comprise a movable element, fixed to one between the door and the stationary structure, pivoted on a fix element, usually fixed to the other between the door and the stationary structure.

Moreover, closing means acting on the movable element to automatically return the door or the like to the closed position are provided.

From the document EP0407150 a door closer is known, which includes a box-like body and an external arm connectable to the door for the automatic returning thereof to the closed position. Such known device has high bulking, since the box-like body has an extremely large size. Therefore, the installation of such a device requires expensive and difficult break-in works of the floor, which have to be made by qualified operators.

Further, due to the presence of the external arm, the aesthetic appeal of this known door closer is dramatically low.

Moreover, this known device offers a high resistance to closing if pulled. As a consequence, it can be very unsafe for a user, in particular in case of glass doors.

SUMMARY OF THE INVENTION

Object of the present invention is to overcome at least partly the above drawbacks, by providing a door closer having characteristics of high effectiveness, constructional simplicity and low cost.

Another object of the invention is to provide a door closer of extremely moderate bulking.

Another object of the invention is to provide a door closer which is extremely easy to install.

Another object of the invention is to provide a door closer which ensures the automatic closing of the door from the open position.

Another object of the invention is to provide a door closer which ensures the controlled movement of the door on which it is mounted, upon the opening as well as upon closing of the door.

Another object of the invention is to provide a door closer which is capable to control the movement of very heavy doors and windows, without changing its behavior and without need of any adjustment.

Another object of the invention is to provide a door closer which has a minimum number of constituent parts.

Another object of the invention is to provide a door closer capable to maintain with time the exact closing position.

Another object of the invention is to provide an extremely safe door closer, which does not offer any resistance to closing if pulled.

Such objects, as well as others which will appear more clearly hereinafter, are fulfilled by a door closer comprising a fix element, suitable to be anchored to one between a door and the stationary structure which support the door, and a movable element, suitable to be anchored to the other between the door and the stationary structure.

The movable element is rotatably coupled to the fix one to rotate about a first longitudinal axis, which may be substantially vertical, between an open door position and a closed door position.

The movable element, respectively the fix element, may comprise a box-like body, which may in turn internally include at least one operating chamber. On the other hand the fix element, respectively the movable element, may comprise a pin which defines the above first longitudinal axis.

Suitably, the door closer comprises closing means acting on the movable element to automatically return the door to the closed position upon the opening thereof.

Furthermore, the door closer may comprise braking means acting on the closing means for counteracting the action thereof.

In this manner, it will be possible to control the rotation of the door from the open position to the closed position.

Advantageously, the closing means may comprise a first cam element interacting with a first plunger element movable within the box-like body between a first compressed end position, corresponding to the open door position and a first extended end position, corresponding to the closed door position.

The first plunger element may move within the box-like body along a first direction, which preferably may be longitudinal and more preferably substantially perpendicular to the first longitudinal axis.

Appropriately, the braking means may comprise a second cam element interacting with a second plunger element movable within the box-like body between a second compressed end position, corresponding to the closed door position and a second extended end position, corresponding to the open door position.

The second plunger element may move within the box-like body along a second direction, which preferably may be longitudinal and more preferably substantially perpendicular to the first longitudinal axis.

In a preferred but non-exclusive embodiment, the two moving directions of the first and the second plunger elements may be parallel each other.

Suitably, the first and second cam elements may be unitary with the pin. In this manner, they may unitary rotate about the first longitudinal axis.

Advantageously, the pin, that is the first and second cam elements, may be interposed between the first and second plunger elements.

Thanks to such features, the door closer will be very compact and effective, and will have a strong aesthetic impact.

Moreover, thanks to such features, the door closer will have a minimum number of constituent parts, with great advantage of the bulkiness of the door closer.

In a preferred but non-exclusive embodiment, the first and second plunger elements may be reciprocally opposite with respect to the pin, or equivalently with respect to the first longitudinal axis.

More precisely, the first and second plunger elements may be reciprocally opposite with respect to a plane passing through the first longitudinal axis and perpendicular to the above first and/or second moving directions of the first and second plunger elements.

Preferably, the closing means and the braking means may be entirely housed in one single operating chamber, internal to the box-like body.

Advantageously, both the first and second plunger elements may be slidably movable along a single second longitudinal axis substantially perpendicular to the first axis. In other words, the first and second moving directions of the first and second plunger elements may lay on a single longitudinal axis, i.e. said second axis.

Preferably, the first and second plunger elements may be slidably movable in a single operating chamber which defines the second axis. In this embodiment, the first and second plunger elements may be reciprocally faced.

Due to bulkiness reasons, the working chamber defined by the box-like body may include both the first and second cam elements and the first and second plunger elements.

Suitably, the first plunger element may comprise at least one first pushing head interacting with at least one substantially first countershaped seat of the first cam element, whereas the second plunger element may include at least one second pushing head interacting with at least one second substantially countershaped seat of the second cam element.

Thanks to this embodiment, the door closer will maintain the exact closing position with time, by being also greatly safe.

In order to minimize the vertical bulkiness, both the at least one first and second pushing heads may have a generally plate-like shape to define respective first and second planes substantially perpendicular to the first axis. Preferably, these first and second planes may be reciprocally parallel.

Advantageously, and independently from the shape of the pushing heads of the plunger elements, the said operating chamber may comprise a working fluid, usually an oil.

Independently from the shape of the pushing heads of the plunger elements, the first plunger element may comprise a substantially cylindrical first back portion and a first front portion defining the first pushing head, whereas the second plunger element may comprise a substantially cylindrical second back portion and a second front portion defining the second pushing head.

The first and second back portions may be designed to separate the operating chamber into a first, a second and a third adjacent variable volume compartments in reciprocal fluidic communication.

Suitably, and independently from the shape of the pushing heads of the plunger elements, the operating chamber may comprise control means for controlling the flow of the working fluid so as to allow the flow thereof from the first compartment to the third compartment through the second compartment upon the opening of the door and to allow the backflow thereof from the third compartment to the first compartment through the second compartment upon the closing of the door.

Such embodiment provides a door closer which ensures the controlled movement of the door upon the opening, thus being greatly safe and practical.

Moreover, thanks to such features, the door closer according to the invention will allow a hydraulic control of the rotation upon the closing of very heavy doors, by also minimizing the bulking.

In fact, the door closer according to the invention will be extremely safe, because the reciprocal rotating movement of the fix and of the movable element is free upon closing. During the closing phase the control means will adjust the backflow of the working fluid from the third to the first variable volume compartment independently from the reciprocal rotation of the fix and of the movable element, so that an user will be free to close the door with any speed without any danger of breaking the door closer and/or the door.

Advantageous embodiments of the invention are defined according to the dependent claims.

BRIEF DESCRIPTION OF THE DRAWINGS

Further features and advantages of the invention will appear more evident upon reading the detailed description of a few preferred, non-exclusive embodiments of a door closer according to the invention, which is described as non-limiting examples with the help of the annexed drawings, in which.

DETAILED DESCRIPTION OF A PREFERRED EMBODIMENT

Referring to the above mentioned figures, the door closer 1 is advantageously applicable to doors, in particular glass doors, which may be supported by a stationary support structure, for example the floor.

In the figures both the door and the stationary support structure, which are not part of the present invention, have not shown because they are known per se.

Figure 1:
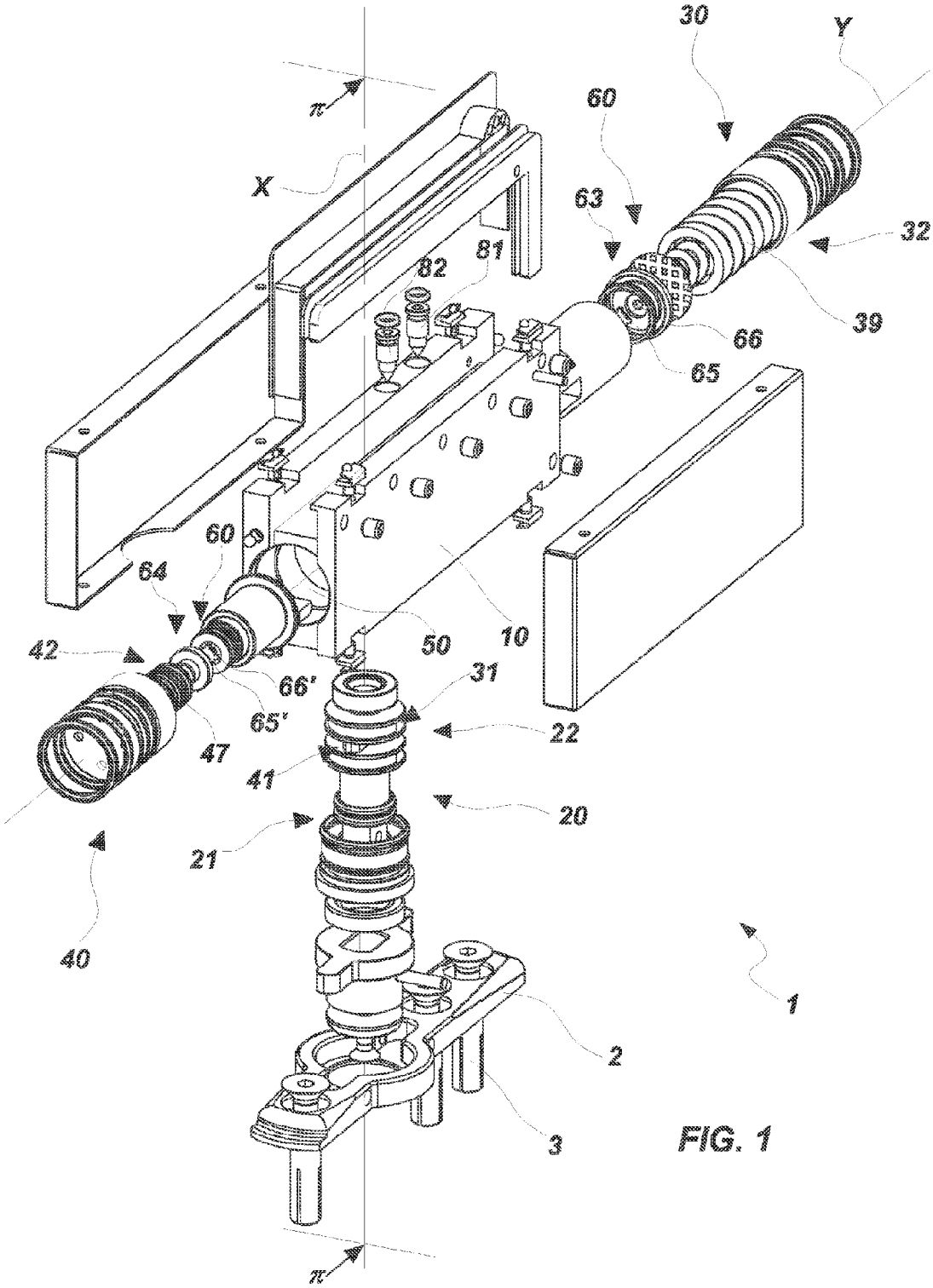
FIG. 1 is an exploded view of a the door closer 1.

Preferably, as particularly visible in FIG. 1, the door closer 1 may include a plate 2, which may be anchored to the stationary support structure, e.g. the floor, by suitable fastener 3.

In this manner, it will be possible to install the door closer 1 easily and smoothly, avoiding for instance the expensive and difficult break-in works which are necessary with the known solutions.

Apparently, the door closer 1 may be equivalently anchored to the support frame of the door.

The door closer 1 may be used individually, with a simple hinge on the other end of the door, or in a combination of two or more of door closers 1.

In particular, the door closer 1 will comprise a box-like body 10 rotatably coupled to a pin 20, in such a manner to rotate about a first longitudinal axis X, which may be substantially vertical.

In the embodiment shown in the appended figures, the box-like body 10 is anchored to the door to define the movable element of the door closer 1, whereas the pin 20 is anchored to the floor S through the plate 2 to define the fix element thereof.

It is understood that, equivalently, the pin 20 may be anchored to the door to define the movable element and the box-like body 10 may be anchored to the stationary support structure S to define the fix one without departing from the scope of protection of the invention defined by the appended claims.

The pin 20, which may have elongated shape to define the axis X, may include a first anchoring portion 21 suitable to the anchoring of the pin 20 to the plate 2 and a second working portion 22, the function of which will be better explainer hereinafter. The first and the second portion may be monolithic, as they are both part of the same pin 20.

In this manner an user, upon the opening of the door, will cause the reciprocal rotation of the box-like body 10 and of the pin 20 around the axis X.

In order to ensure the automatic closing of the door once opened, closing means may be provided, generally indicated with 30, acting on the movable element of the door closer 1 to automatically return the door to the closed position.

Braking means, generally indicated with 40, acting on the closing means 30 to counteract the action thereof, may be further provided.

Figure 2:
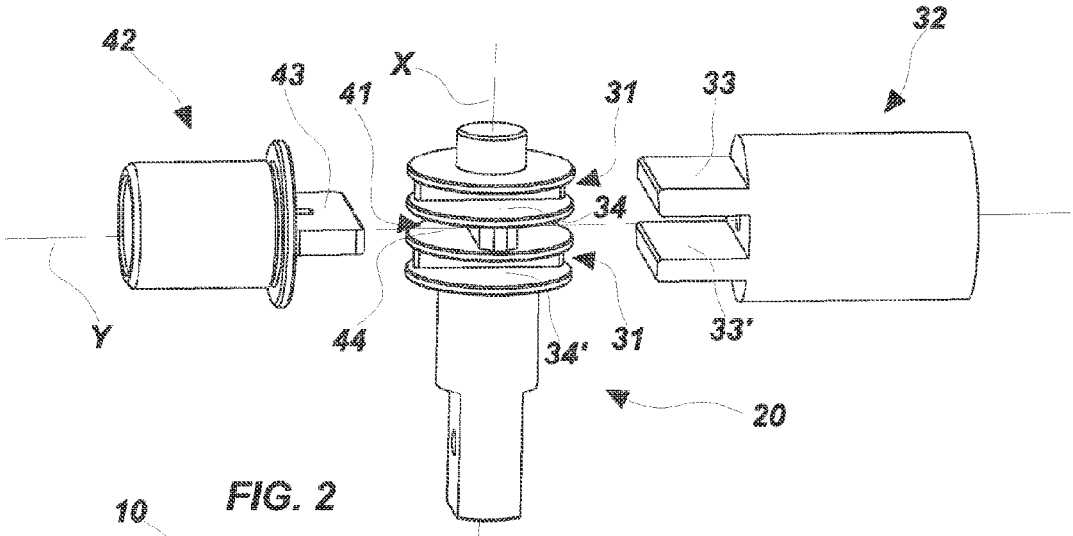
FIG. 2 is a schematic perspective view of the first and second cam elements 31 and 41, unitary with the pin 20, which are interposed between the first and second plunger elements 32, 42.

As particularly visible in FIG. 2, the closing means 30 may comprise a first cam element 31 interacting with a first plunger element 32, whereas the braking means 40 may include a second cam element 41 interacting with a second plunger element 42.

As used herein, the term "cam" means a mechanical part, having any configuration, suitable to change a circular motion into a rectilinear motion.

Both the first and second cam elements 31, 41 may be unitary with the pin 20, in such a manner to unitary rotate therewith. In particular, the first and second cam elements 31, 41 may define the working portion 22 of the pin 20.

On the other hand, the first and second plunger elements 32, 42 may be movable within the box-like body 10.

In a preferred but non-exclusive embodiment, both the plunger elements 32, 42 may be slidably movable in a single operating chamber 50, which defines a second longitudinal axis Y substantially perpendicular to the first axis X.

Suitably, the operating chamber 50 may house also the first and second cam elements 31, 41. Appropriately, the operating chamber 50 may be cylindrical.

In particular, the first plunger element 32 may slidably move along the second axis Y between a first compressed end position, corresponding to the open door position, and a first extended end position, corresponding to the closed door position.

On the other hand, the second plunger element 42 may slidably move along the second axis Y between a second compressed end position, corresponding to the closed door position, and a second extended end position, corresponding to the open door position.

Advantageously, the pin 20, or equivalently the longitudinal axis X, or equivalently the first and second cam elements 31, 41, may be interposed between the first and second plunger elements 32, 42.

Suitably, in the preferred, non-exclusive embodiment shown in the appended figures, the first and second plunger elements 32, 42 may be reciprocally opposite with respect to a plane $\pi$ passing through the first longitudinal axis X and perpendicular to the second longitudinal axis Y.

Advantageously, the first and second plunger elements 32, 42 may be reciprocally faced in the operating chamber 50.

Appropriately, the box-like body 10 may have an elongated shape along the axis Y. In other words, the box-like body 10 may develop mainly in length along the axis Y, with the length dimension higher than the other two dimensions.

In a preferred but non-exclusive embodiment of the invention, the first plunger element 32 may comprise a couple of first pushing heads 33, 33' interacting with a corresponding couple of substantially first countershaped seats 34, 34' of the first cam element 31, whereas the second plunger element 42 may include a second pushing head 43 interacting with a second substantially countershaped seat 44 of the second cam element 41.

Advantageously, both the first pushing heads 33, 33' and the second one 43 may have a generally plate-like shape to define respective first planes $\pi$, $\pi''$ and a second plane $\pi'''$.

Thanks to the above features, the bulk of the body, in particular the vertical one, will be extremely minimized, and the aesthetic appeal greatly increased.

Suitably, the second plane $\pi'''$ defined by the second pushing head 43 may lie between the first planes $\pi'$, $\pi''$ defined by the first pushing heads 33, 33'.

Figure 4A:
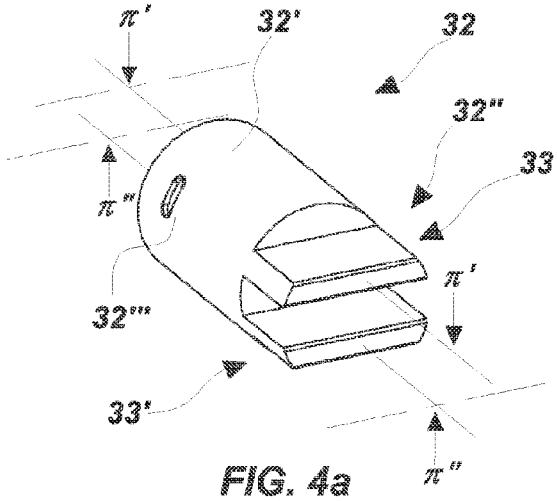
FIGS. 4*a* and 4*b* are respectively perspective and sectional views of the first plunger element 32.
Figure 4B:
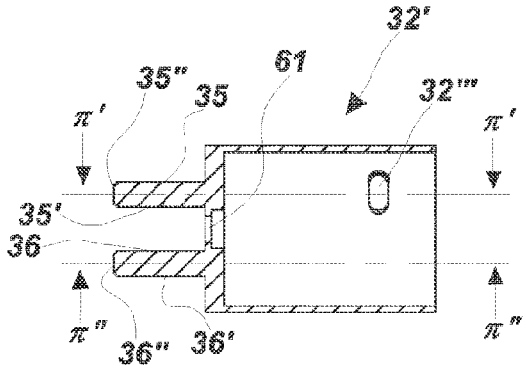
Figure 5A:
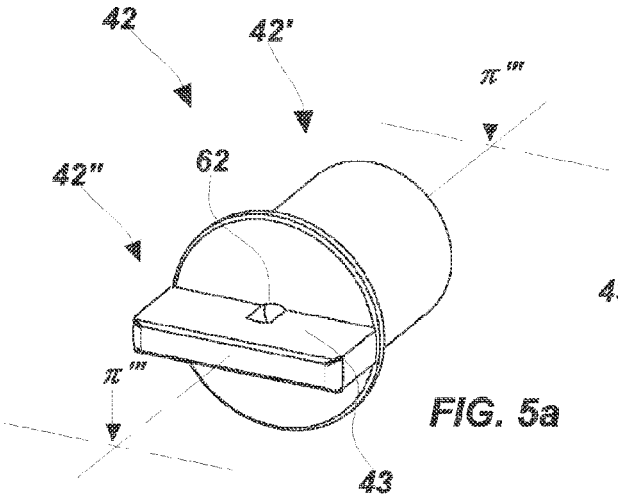
FIGS. 5*a*, 5*b* and 5*c* are respectively perspective, sectional and front views of the second plunger element 42.
Figure 5B:
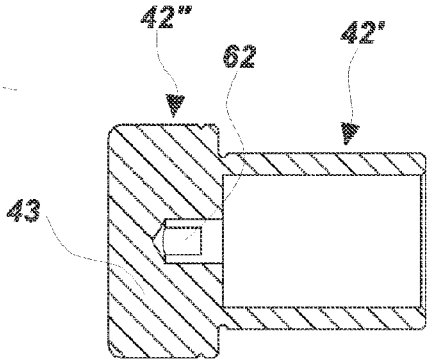
Figure 5C:
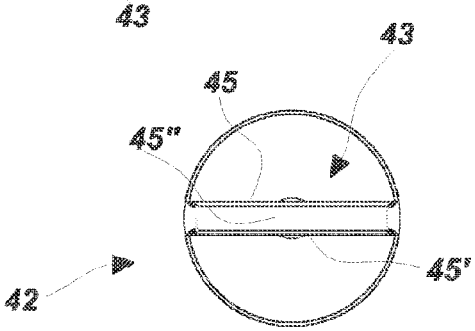
Figure 6A:
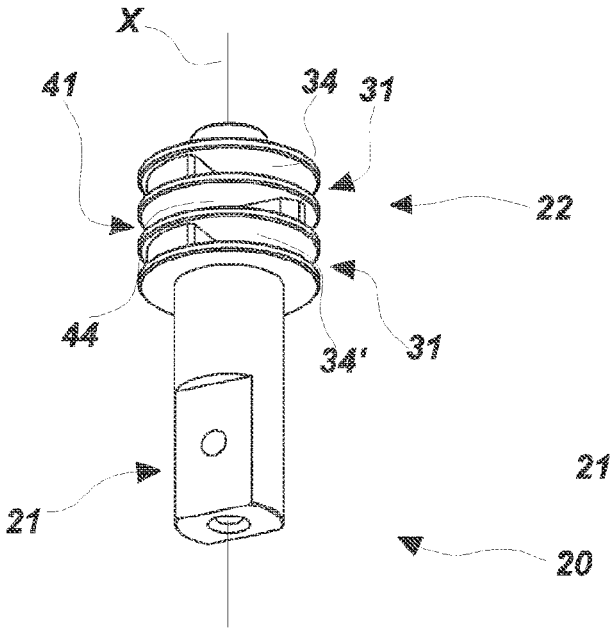
FIGS. 6*a*, 6*b* and 6*c* are respectively perspectives and side views of the first and second cam element 31, 41, which are unitary with the pin 20.
Figure 6B:
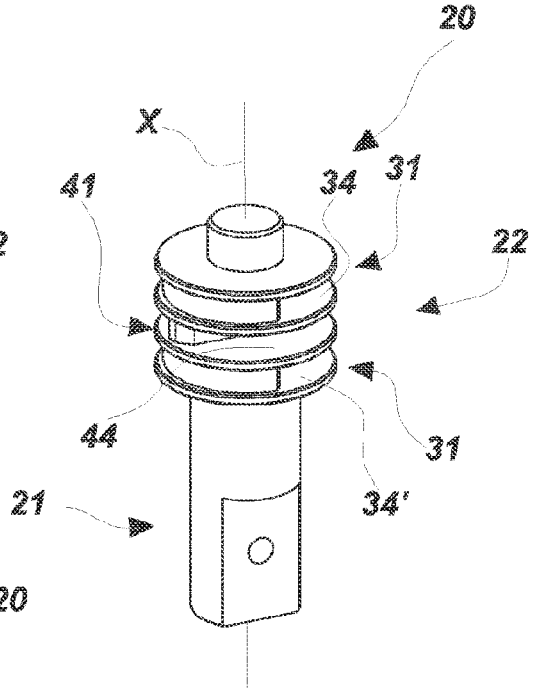
Figure 6C:
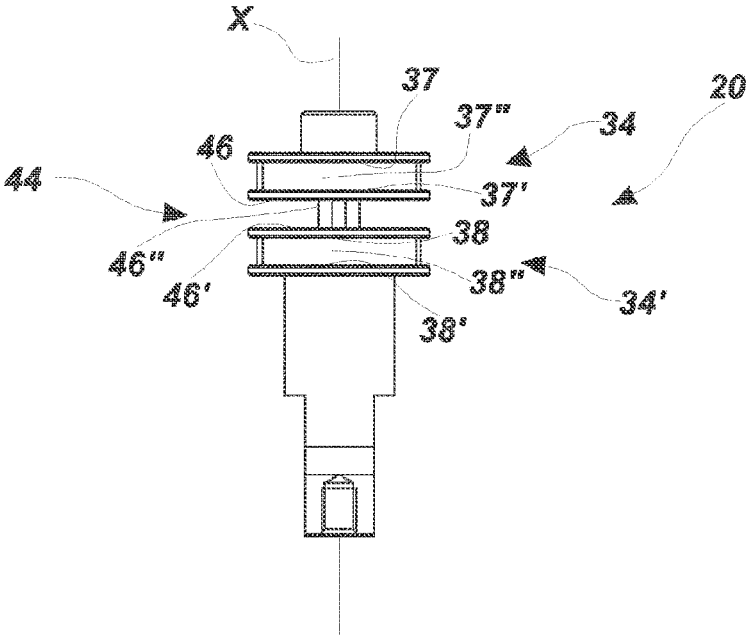
Figure 7A:
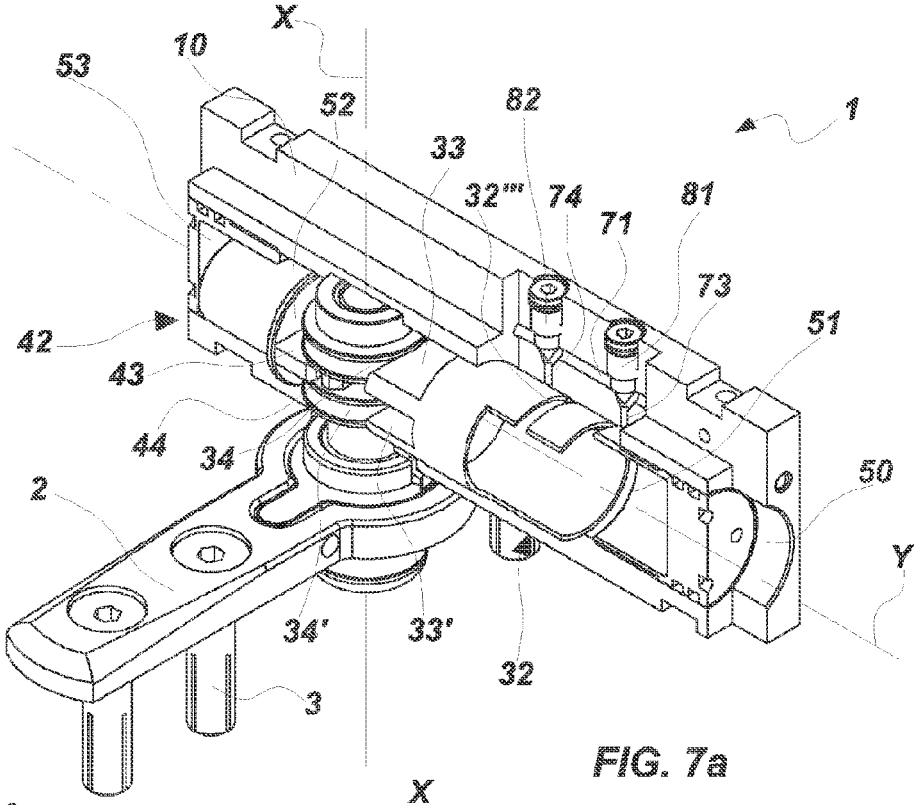
FIGS. 7*a* and 7*b* are respectively sectional perspective and side views of the door closer 1 in the open door position, wherein the discharging port 72 and the third pass-through hole 32''' are reciprocally uncoupled (the first and second springs 39, 47 have not been shown for sake of better intelligibility)
Figure 7B:
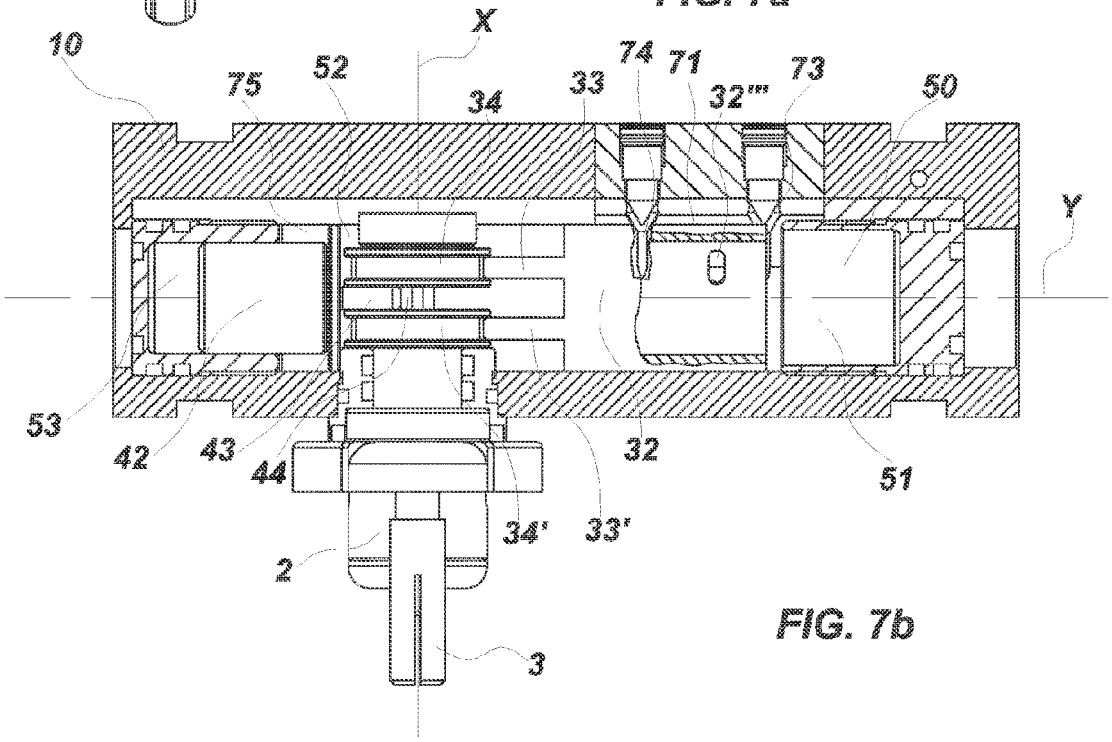
Figure 8A:
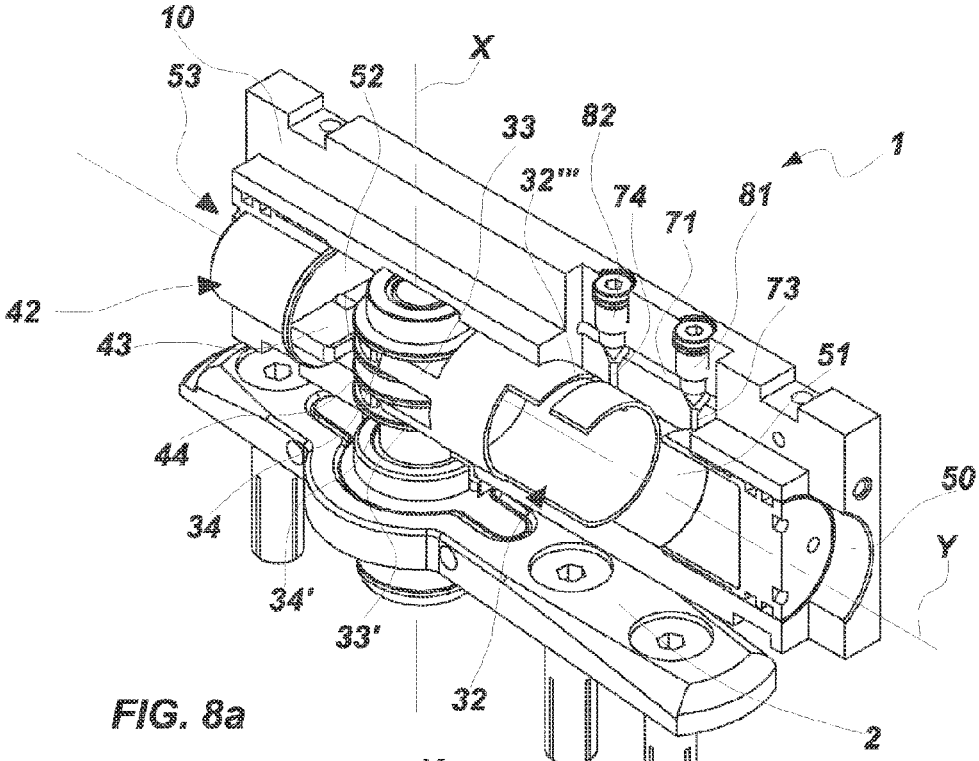
FIGS. 8*a* and 8*b* are respectively sectional perspective and side views of the door closer 1 in a position proximate to the closed door position, wherein the discharging port 72 and the third pass-through hole 32''' are reciprocally coupled to selectively put into fluidic communication the channel 71 with the first variable volume compartment 51, so as to impart a latch action to the door towards the closed position (the first and second springs 39, 47 have not been shown for sake of better intelligibility)
Figure 8B:
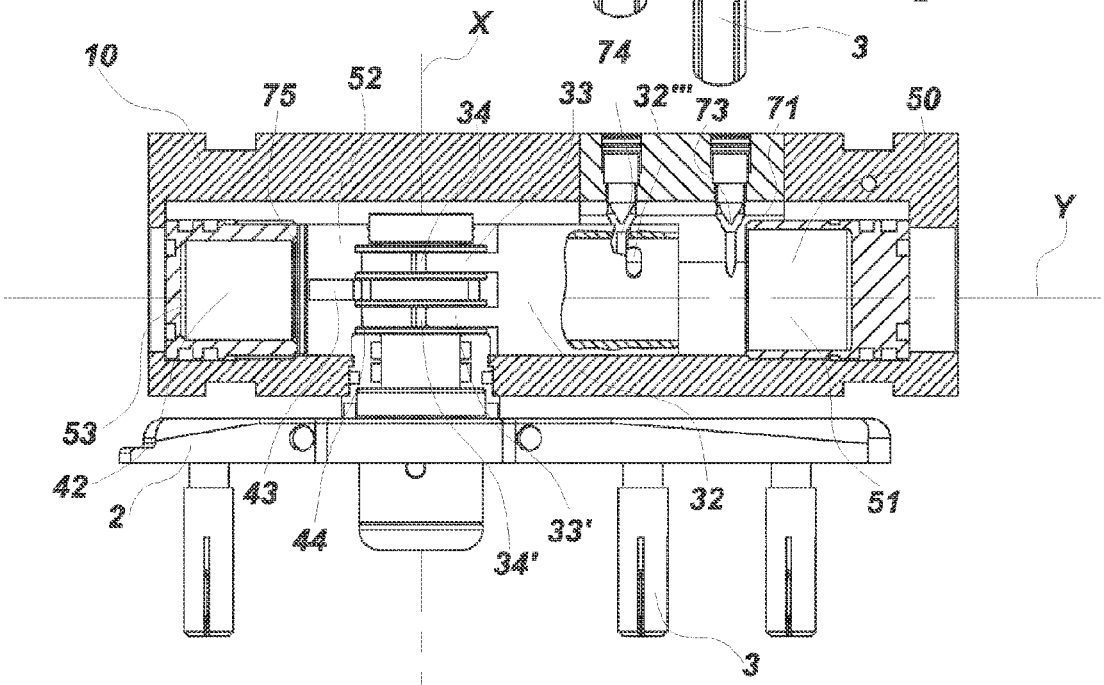
Figure 9A:
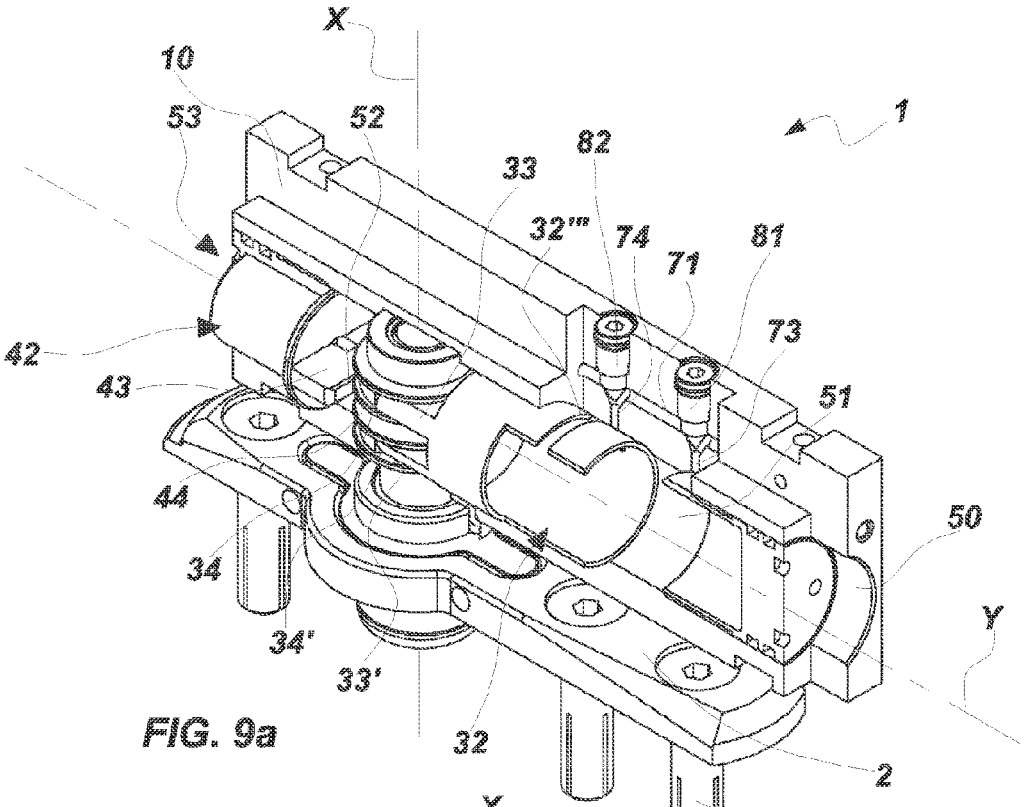
FIGS. 9*a* and 9*b* are respectively sectional perspective and side views of the door closer 1 in the closed door position (the first and second springs 39, 47 have not been shown for sake of better intelligibility).
Figure 9B:
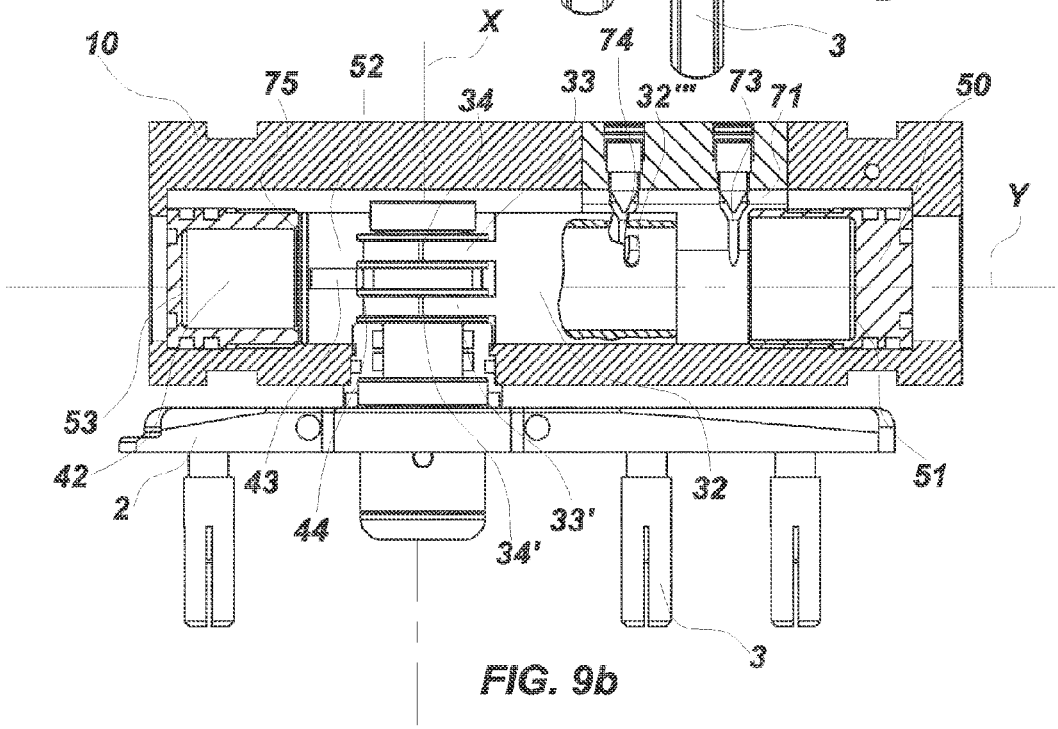

As particularly shown in FIG. 4, the pushing heads 33, 33' and 43 may include respective couples of substantially flat upper and lower walls, respectively indicated with 35 and 35'; 36 and 36', 45 and 45'.

On the other hand, the countershaped seats 34, 34' and 44 may comprise respective couples of substantially flat upper and lower walls, respectively indicated with 37 and 37'; 38 and 38', 46 and 46'. The upper and lower walls 35 and 35'; 36 and 36' of the pushing heads 33, 33' may respectively face the corresponding upper and lower walls 37 and 37'; 38 and 38' of the countershaped seats 34, 34', whereas the upper and lower walls 45 and 45' of the pushing head 43 may face the corresponding upper and lower walls 46 and 46' of the countershaped seat 44.

In a preferred but-non exclusive embodiment of the invention, all the planes $\pi'$, $\pi''$ and $\pi'''$ may be substantially perpendicular to the first axis X and preferably reciprocally parallel.

Suitably, the upper and lower walls 35 and 35'; 36 and 36', 45 and 45', 37 and 37'; 38 and 38', 46 and 46' may be all substantially parallel to the second axis Y.

It is however understood that the pushing heads 33, 33' and 43 may have any shape, as long as substantially plate-like, without departing from the scope of protection of the invention defined by the appended claims. For instance, the pushing heads 33, 33' and 43 may be substantially wedge-shaped, with converging upper and lower walls.

Appropriately, the first pushing heads 33, 33' may comprise respective first flat front faces 35" and 36", whereas the second pushing head 43 may comprise a second flat front face 45".

The front faces 35", 36" and 45" may be all substantially parallel each other and to the first longitudinal axis X.

The first countershaped seats 34, 34' may include respective first substantially flat contact surfaces 37", 38", whereas the second countershaped seat 44 may include a second substantially flat contact surface 46".

The first contact surfaces 37", 38" may be reciprocally parallel each other, and in particular they may be co-planar, i.e. they may lie on the same plane. On the other hand, the first contact surfaces 37", 38" may be perpendicular to the second countershaped seat 44.

The front faces 35", 36" and 45" may respectively be in contact engage with the contact surfaces 37", 38" and 46".

As already pointed out above, the cam elements 31, 41 are unitary with the pin 20, in such a manner that they can rotate therewith about the vertical axis X. Therefore, also the contact surfaces 37", 38" and 46" of the countershaped seats 34, 34' and 44 will rotate about the axis X unitary with the pin 20.

The first front faces 35", 36" and the first contact surfaces 37", 38" will be substantially parallel to each other in the closed door position and substantially perpendicular to each other in the open door position, whereas the second front face 45" and the second contact surface 46" will be substantially perpendicular to each other in the closed door position and substantially parallel to each other in the open door position.

To promote the pushing of the heads 33, 33' of the first plunger element 32 against the countershaped seats 34, 34' of the first cam element 31, that is to promote the interaction between the first front faces 35", 36" and the first contact surfaces 37", 38", first counteracting elastic means may be provided, which may comprise, respectively consist of, a first spring 39 acting on the first plunger element 32.

On the other hand, to promote the pushing of the head 43 of the second plunger element 42 against the countershaped seat 44 of the second cam element 41, that is to promote the interaction between the second front face 45" and the second contact surfaces 46", second counteracting elastic means may be provided, which may comprise, respectively consist of, a second spring 47, acting on the first second element 42.

Advantageously, the first contact surfaces 37", 38" of the first cam element 31 may be designed according to the teachings of the International Patent Application WO2007125524, in the name of the same Applicant.

In particular, the first contact surfaces 37", 38" of the first cam element 31 may be offset with respect to the axis X of a predetermined distance, such as the first front faces 35", 36" of the first plunger element 32 in its extended end position is positioned beyond said axis X.

Suitably, the surfaces 37", 38" may have a distance from the axis X which may be comprised between 1 mm and 6 mm, preferably comprised between 1 and 3 mm and even more preferably close to 2 mm.

Thanks to such feature, the closing movement of the door closer will be completely automatic. In other words, the plunger element 32 will start to work after few rotation degrees, starting from the open position.

In a preferred, not-exclusive embodiment of the invention, the operating chamber 50 may be filled with a predetermined quantity of a working fluid, usually oil.

The first plunger element 32 may comprise a substantially cylindrical first back portion 32' and a first front portion 32" which include the first pushing heads 33, 33', whereas the second plunger element 42 may comprise a substantially cylindrical second back portion 42' and a second front portion 42" including the second pushing head 43.

Appropriately, the first and second back portions 32', 42' may be designed to separate the operating chamber 50 into a first, a second and a third adjacent variable volume compartments in reciprocal fluidic communication, respectively indicated 51, 52 and 53.

The three compartments 51, 52 and 53 may be designed in such a manner that the second compartment 52 is interposed between the first and third compartments 51, 53. In this manner, the fluidic communication between the first and third compartments 51, 53 will necessarily involves the passage of the working fluid trough the second compartment 52.

Appropriately, the first variable volume compartment 51 houses the first counteracting elastic means 39, the third variable volume compartment 53 houses the second counteracting elastic means 47 and the second variable volume compartment 52 houses both the first and second cam elements 31, 41.

Suitably, the first and third compartments 51, 53 may be designed to have in correspondence of the closed door position respectively the maximum and minimum volume, whereas in correspondence of the open door position respectively the minimum and maximum volume.

In a preferred but non-exclusive embodiment of the invention, the operating chamber 50 comprises control means, generally indicated with 60, to control the flow of the working fluid, in such a manner to allow the flow thereof from the first compartment 51 to the third compartment 53 through the second compartment 52 upon the opening of the door and to allow the backflow thereof from the third compartment 53 to the first compartment 51 through the second compartment 52 upon the closing of the door D.

Advantageously, the control means 60 may comprise a first hole 61 passing through the first plunger element 32, preferably in correspondence of the first front portion 32" thereof, so as to put into fluidic communication the first compartment 51 and the second compartment 52, and a second hole 62 passing through the second plunger element 42, preferably in correspondence of the first front portion 42" thereof, so as to put into fluidic communication the third compartment 53 and the second compartment 52.

Furthermore, the control means 60 may comprise a first check valve 63 interacting with the first pass-through hole 61 and a second check valve 64 interacting with the second pass-through hole 62.

The first and second check valves 63, 64 reciprocally cooperate so as to allow the flow of the working fluid from the first compartment 51 to the second compartment 52 through the first pass-through hole 61 and from the second compartment 52 to the third compartment 53 through the second pass-through hole 62 upon the opening of the door D, and to prevent the backflow thereof upon the closing of the same door D.

With this purpose the check valves 63, 64 interacting with the pass-through holes 61, 62 may be of the butterfly type, with the butterflies 65, 65' housed in the compartments 66, 66' in correspondence with the inlet of the pass-through holes 61, 62.

This way, when the door is opened, that is when it passes from the closed door position to the open one, the decreasing of volume of the first compartment 51, i.e. the pressure of the working fluid in the compartment, will causes the butterfly element 65 axially slide in the compartment 66, in such a manner that the working fluid is free to flow through the hole 61 towards the second compartment 52.

At the same time the pressure of the working fluid in the second compartment 52 will causes the butterfly element 65' axially slide in the compartment 66', in such a manner that the working fluid is free to flow through the hole 62 towards the third compartment 53.

Vice versa, when the door is closed, that is when it passes from the open position to the closed one, the butterfly elements 65, 65' will axially slide in the direction opposite to the opening one and will close, thus preventing the backflow of the working fluid through the holes 61, 62.

In order to allow the controlled backflow of the working fluid, the control means 60 may further comprise a hydraulic circuit, generally indicated with 70, internal to the box-like body 10.

Advantageously, the hydraulic circuit 70 may comprise a channel 71 in fluidic communication with the operating chamber 50 to allow the controlled backflow of the working fluid from the third compartment 53 to the first compartment 51 through said second compartment 52 upon the closing of the door D.

Figure 3A:
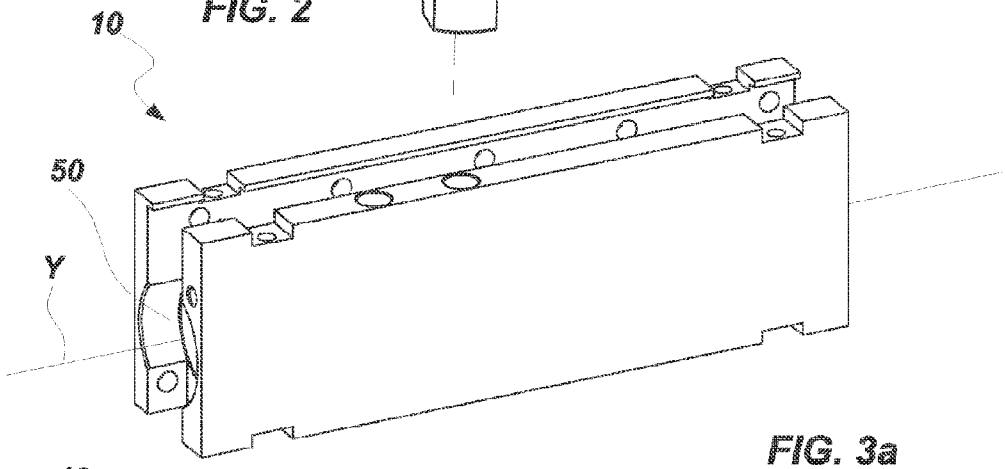
FIGS. 3*a* and 3*b* are respectively perspective and partly sectional views of the box-like body 10.
Figure 3B:
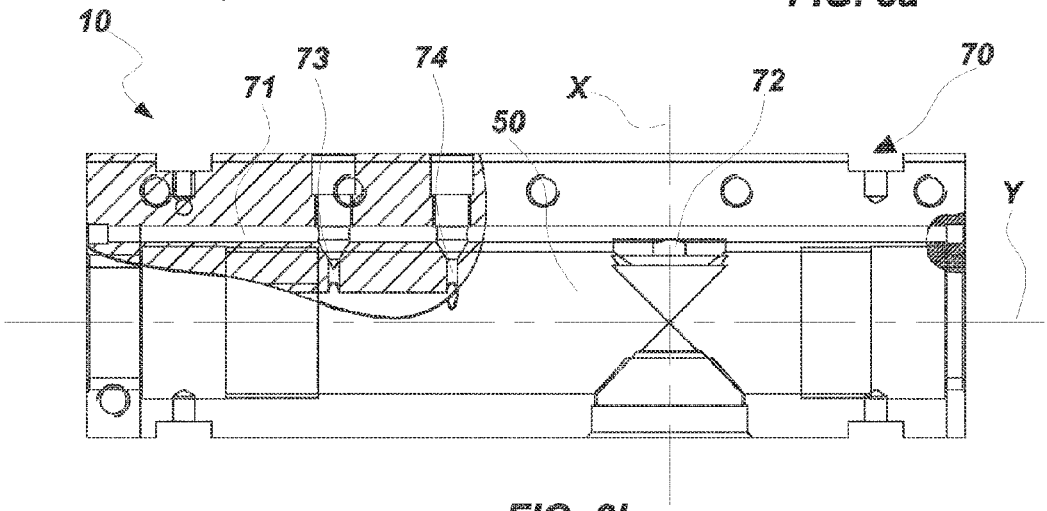

Suitably, the channel 71 may comprise an inlet port 72, particularly visible in FIG. 3*b*, and at least one first outlet port 73. Preferably, the channel 71 may comprise a second outlet port 74, the function of which is better explained below.

The inlet port 72 may put into fluidic communication the second compartment 52 and the channel 71, while the first outlet port 73 may put into fluidic communication the channel 71 and the first compartment 51.

Appropriately, the second plunger element 42 may be inserted into the operating chamber 50 with a predetermined clearance, in such a manner that the cylindrical outer surface of the back portion 42' thereof will define an interspace 75, preferably substantially tubular, with the side wall of the operating chamber 50. The interspace 75 may be suitable to put into a mutual fluidic communication the third and second variable volume compartments 53, 52.

In this manner, when the door is closed, that is when it passes from the open door position to the closed one, the decreasing of volume of the third compartment 53, i.e. the pressure of the working fluid in the compartment, will causes the flowing of the working fluid through the interspace 75, in such a manner to flow towards the second compartment 52.

At the same time the pressure of the working fluid in the second compartment 52 will causes the flowing of the working fluid through the inlet port 72, the channel 71 and the first outlet port 73, until the first compartment 51.

Thanks to the above features, it will be possible to control the rotation of the door from the open to the closed position and vice versa. More generally, the door closer according to the invention ensures a controlled movement of the door upon the opening as well as upon the closing thereof.

In fact, upon the opening, the controlled movement will prevent the door from suddenly opening, so as to protect both the door itself and a possible user who is in the corresponding action area. Further, upon the closing, the controlled movement will allow to prevent the said door from strongly impact with the frame.

Thanks to such features, the door closer according to the invention will be extremely safe and practical for a user.

The door closer according to the invention will be greatly safe also because the reciprocal rotating movement of the fix and of the movable element is free upon its closing. In fact, upon the closing phase, the oil will flow from the third compartment 53 to the second one 52 and then to the first one 51 independently from the reciprocal rotation speed of the fix and movable elements.

In this manner, a user will be free to close the door with any speed without any danger to break the door closer or the door.

In order to adjust the rotation speed of the door from the open to the closed position, the channel 71 may include first suitable adjusting means.

Advantageously, the first adjusting means may comprise a first screw 81 passing through the box-like body 10 and interacting with the first outlet port channel 73 to obstruct the passing section of the working fluid therein.

In this manner, it is possible to adjust the passing section of the first outlet port 73, i.e. adjusting the volume of working fluid which passes through it, thus adjusting the closing speed of the door.

Suitably, the first back portion 32" of the first plunger element 32 may comprise a third pass-through hole 32'", slidable unitarily therewith along the second longitudinal axis Y.

Advantageously, the second outlet port 74 of the channel 71 and the third pass-through hole 32'" are susceptible to be reciprocally uncoupled when the first plunger element 32, during its sliding along the axis Y, is in proximity of the compressed end position and reciprocally coupled when the same first plunger element 32 is in proximity of the extended end position.

In the last position, the coupling between the second outlet port 74 and the third pass-through hole 32'" will selectively put into fluidic communication the channel 71 and the first variable volume compartment 51, so as to impart a latch action to the door towards the closed position. Appropriately, in order to adjust the above latch action, i.e. the force by which the door accelerates towards the closed position, the channel 71 may include second suitable adjusting means.

Advantageously, the second adjusting means may comprise a second screw 82 passing through the box-like body 10 and interacting with the second outlet port 74 to obstruct the passing section of the working fluid therein.

In this manner, it is possible to adjust the passing section of the second outlet port 74, i.e. adjusting the volume of working fluid which passes through it, thus adjusting the latch action of the door towards the closed position. Suitably, the first outlet port 73 may be located downstream of the second outlet port 74 along the channel 71.

Advantageously, the first outlet port 73 may be located sufficiently far from the second outlet port 74, in such a manner that the back portion 32' of the first plunger element 32 will not obstruct the passage of the working fluid through it during its sliding along the axis Y.

From the above description, it is evident that the door closer according to the invention fulfills the intended objects.

The door closer according to the invention is susceptible to many changes and variants, all falling within the inventive concept expressed in the annexed claims. All particulars may be replaced by other technically equivalent elements, and the materials may be different according to the needs, without departing from the scope of the invention.

Although the door closer has been particularly described referring to the annexed figures, the reference numbers used in the description and claims are used to improve the intelligence of the invention and do not constitute any limit to the claimed scope.

The invention claimed is:

1. A door closer for a door which is supportable by a stationary support structure, the door being movable between an open door position and a closed door position, the door closer comprising:

a box-shaped body anchorable to one of the stationary support structure or the door;

a pin defining a first longitudinal axis, the pin being anchorable to the other one of the stationary support structure or the door, said pin and said box-shaped body being reciprocally and rotatably coupled to rotate around said first longitudinal axis between the open door position and the closed door position;

a closing mechanism for automatic return of the door from the open to the closed position;

a braking mechanism acting on said closing mechanism configured to counteract an action thereof;

said closing mechanism comprising a first cam element interacting with a first plunger element movable within said box-shaped body between a first compressed end position corresponding to the open door position and a first extended end position corresponding to the closed door position; and said braking mechanism comprising a second cam element interacting with a second plunger element movable within said box-shaped body between a second compressed end position, corresponding to the closed door position and a second extended end position, corresponding to the open door position;

wherein both said first and said second cam elements are unitary with said pin, wherein said first plunger element comprises at least one first pushing head interacting with at least one substantially first countershaped seat of said first cam element, said second plunger element including at least one second pushing head interacting with at least one second substantially countershaped seat of said second cam element, wherein said at least one first and second pushing heads comprise respectively at least one first and second front faces, said at least one first and second countershaped seats comprising respective at least one first and second contact surfaces, said at least one first and second front faces being in contact engagement with said at least one first and second contact surfaces, wherein said pin is interposed between said first and second plunger elements, and wherein said first and second plunger elements are both slidably movable in an operating chamber internal to the box-shaped body along a second axis substantially perpendicular to said first axis, both said at least one first and said second pushing heads being shaped to define respectively at least one first and second planes substantially perpendicular to said first axis.

2. The door closer according to claim 1, wherein said first and said second countershaped seats are defined between walls extending perpendicularly from said pin, wherein said first pushing head comprises at least one plate-shaped member disposed to nest between a first pair of said walls, and wherein said second pushing head comprises a second plate-shaped member disposed to nest between a second pair of said walls.

3. The door closer according to claim 2, wherein said first countershaped seat is defined between said first pair of said walls, said second countershaped seat being defined between said second pair of said walls.

4. The door closer according to claim 2, wherein said first pushing head comprises a first plate-shaped member and a second plate-shaped member disposed to nest respectively between an upper pair and a lower pair of said walls, said second countershaped seat being defined between said upper pair and said lower pair of said walls.

5. The door closer according to claim 1, wherein said first and second plunger elements are mutually opposite with respect to said pin.

6. The door closer according to claim 1, wherein said at least one first and second planes are mutually parallel.

7. The door closer according to claim 1, wherein said at least one first front face and said at least one first contact surface are substantially parallel to each other in said closed door position and substantially perpendicular to each other in said open door position, said at least one second front face and said at least one second contact surface being substantially perpendicular to each other in said closed door position and substantially parallel to each other in said open door position.

8. The door closer according to claim 1, wherein said closing mechanism comprises a first counteracting elastic element acting on said first plunger element to promote a mutual interaction of said at least one first pushing head and said at least one first countershaped seat, said braking mechanism comprising a second counteracting elastic element acting on said second plunger element to promote a mutual interaction of said at least one second pushing head and said at least one second countershaped seat.

9. The door closer according to claim 1, wherein the box-shaped body is anchorable ro the door, and wherein the pin is anchorable to the stationary support structure.

10. The door closer according to claim 1, further comprising a plate through which the box-shaped body is installed on a floor.

11. A door closer for a door which is supportable by a stationary support structure, the door being movable between an open door position and a closed door position, the door closer comprising:

a box-shaped body anchorable to one of the stationary support structure or the door;

a pin defining a first longitudinal axis, the pin being anchorable to the other one of the stationary support structure or the door, said pin and said box-shaped body being reciprocally and rotatably coupled to rotate around said first axis between the open door position and the closed door position;

a closing mechanism for automatic return of the door from the open to the closed position;

a braking mechanism acting on said closing mechanism configured to counteract an action thereof, and said closing mechanism comprising a first cam element interacting with a first plunger element movable within said box-shaped body between a first compressed end position corresponding to the open door position and a first extended end position corresponding to the closed door position; and said braking mechanism comprising a second cam element interacting with a second plunger element movable within said box-shaped body between a second compressed end position, corresponding to the closed door position, and a second extended end position, corresponding to the open door position;

wherein both said first and said second cam elements are unitary with said pin, wherein said first plunger element comprises at least one first pushing head interacting with at least one substantially first countershaped seat of said first cam element, said second plunger element including at least one second pushing head interacting with at least one second substantially countershaped seat of said second cam element, wherein said pin is interposed between said first and second plunger elements, said first and second plunger elements being both slidably movable in a operating chamber internal to the box-shaped body along a second axis substantially perpendicular to said first axis, wherein said operating chamber comprises a working fluid, said first plunger element comprising a substantially cylindrical first back portion and a first front portion including said at least one first pushing head, said second plunger element comprising a substantially cylindrical second back portion and a second front portion which include said at least one second pushing head, wherein said operating chamber is separated into a first, a second and a third adjacent variable volume compartments in reciprocal fluidic communication, the first variable volume compartment including said first plunger element, the third variable volume compartment including said second plunger element, the second variable volume compartment including said pin, and wherein the door closer further comprises a flow control system for controlling the flow of the working fluid designed to allow the flow thereof from said first compartment to said third compartment through said second compartment upon the opening of the door and to allow a backflow thereof from said third compartment to said first compartment through said second compartment upon the closing of the door.

12. The door closer according to claim 11, wherein said flow control system includes a first hole passing through said first plunger element to put into fluidic communication said first compartment and said second compartment and a second hole passing through said second plunger element to put into fluidic communication said third compartment and said second compartment, wherein said flow control system further comprises an hydraulic circuit to put into fluidic communication said third compartment and said first compartment through said second compartment.

13. The door closer according to claim 12, wherein said second plunger element includes a check valve interacting with said second hole to selectively open upon the opening of the door for allowing a flow of the working fluid from said first compartment to said second compartment through said first hole and from said second compartment to said third compartment through said second hole, and to selectively close upon the closing of the door for preventing a backflow of the working fluid therethrough, said hydraulic circuit allowing the backflow of the working fluid upon the closing of the door.

14. The door closer according to claim 13, wherein said hydraulic circuit comprises an interspace between said second plunger element and said operating chamber to put into fluidic communication said third variable volume compartment and said second variable volume compartment, said hydraulic circuit further including a channel passing through said box shaped body having at least one inlet port in fluidic communication with said second variable volume compartment and at least one outlet port in fluidic communication with said first variable volume compartment.

15. The door closer according to claim 14, wherein said at least one outlet port comprises a first outlet port and a second outlet port, said first outlet port being in continuous fluidic communication with said second variable volume compartment and said second outlet port being in intermittent fluidic communication with said second variable volume compartment, said intermittent fluidic communication being provided by a third pass-through hole defined on said first plunger element such that a sliding of said first plunger element causes an intermittent contact between said third pass-through hole and said second outlet port.

16. The door closer according to claim 15, further comprising an obstruction member configured to obstruct a passing section in said at least one outlet port, thereby regulating flow of said working fluid therethrough.

17. The door closer according to claim 16, wherein said obstruction member comprises a screw.

18. The door closer according to claim 11, wherein the box-shaped body is anchorable to the door, and wherein the pin is anchorable to the stationary support structure.

19. The door closer according to claim 11, further comprising a plate through which the box-shaped body is installed on a floor.

* * * * *